US006629334B2

(12) United States Patent
Huang

(10) Patent No.: US 6,629,334 B2
(45) Date of Patent: Oct. 7, 2003

(54) STRUCTURE OF A HINGE

(76) Inventor: Yueh-Nu Huang, No. 56, Min Sheng Street, Feng-Yuan City 42041 (TW)

( * ) Notice: Subject to any disclaimer, the term of this patent is extended or adjusted under 35 U.S.C. 154(b) by 0 days.

(21) Appl. No.: 09/921,340

(22) Filed: Jan. 7, 2002

(65) Prior Publication Data

US 2002/0062533 A1 May 30, 2002

Related U.S. Application Data

(63) Continuation of application No. 09/482,967, filed on Jan. 11, 2000, now abandoned.

(51) Int. Cl.[7] ..... E05F 1/06
(52) U.S. Cl. ..... 16/50; 16/71
(58) Field of Search ..... 16/50, 276, 285, 16/297, 299, 307, 309, 312, 316, 317, 318, DIG. 10, 386, 71, 72

(56) References Cited

U.S. PATENT DOCUMENTS 4,631,777 A * 12/1986 Takimoto ..... 16/315
4,756,051 A * 7/1988 Shy ..... 16/50
4,864,690 A * 9/1989 Chen ..... 16/276
5,133,152 A * 7/1992 Grancagnolo ..... 49/239
5,152,029 A * 10/1992 Pai ..... 16/54
5,855,040 A * 1/1999 Lin ..... 16/50
6,205,619 B1 * 3/2001 Jang ..... 16/352

* cited by examiner

*Primary Examiner*—Anthony Knight
*Assistant Examiner*—Doug Hutton

(57) ABSTRACT

A structure of a hinge is provided. The hinge includes a main leave secured to a door frame and a subordinate leave joint with the main leave by a pintle and secured to a door. The main leave has a first helical surface in a lower knuckle and the subordinate leave has a second helical surface in a central knuckle engaged with the first helical surface. Further the first helical surface has a vertical end and a plurality of domes engageable with a vertical end and a plurality of semi-circular recesses. So that when the door is opened, it will gradually and slowly closed on its own gravity.

1 Claim, 5 Drawing Sheets

STRUCTURE OF A HINGE

This application is a continuation of Ser. No. 09/482,967, filed Jan. 11, 2000, which is now abandoned.

BACKGROUND OF THE INVENTION

The present invention relates to automatic door closers and more particularly to a structure of a hinge which utilizes the gravity of the door to automatically and retardatively close the door of a house or of a furniture.

Conventional automatic door closer are varied in types. The earliest type of them utilizes a spring or springs to retard the movement of the door. However, it makes a noise. The latest type of them (as shown in FIG. 1) utilizes hydraulic or pneumatic device which comprises a hydraulic or pneumatic tube 10, a shaft 15 having one end pivoted to a door frame 14 and the other end pivoted to a rod 11 which has a free end 12 fixed to a back side of a door 13. When the door 13 is opened, it will be slowly closed without any noise. However, leakage of oil or air may occur after long period of usage and thus will reduce the hydraulic and pneumatic power.

SUMMARY OF THE PRESENT INVENTION

The present invention has a main object to provide a structure of a hinge which utilizes the gravity of a door to retard the closing movement of the door without causing a noise.

Another object of the present invention is to provide a structure of a hinge to automatically and slowly close a door without using an automatic door closer.

Further object of the present invention is to provide a structure of a hinge which is simple, convenient and durable.

The present invention will become more fully understood by reference to the following detailed description thereof when read in conjunction with the attached drawings.

DETAILED DESCRIPTION OF THE PREFERRED EMBODIMENT

Figure 1:
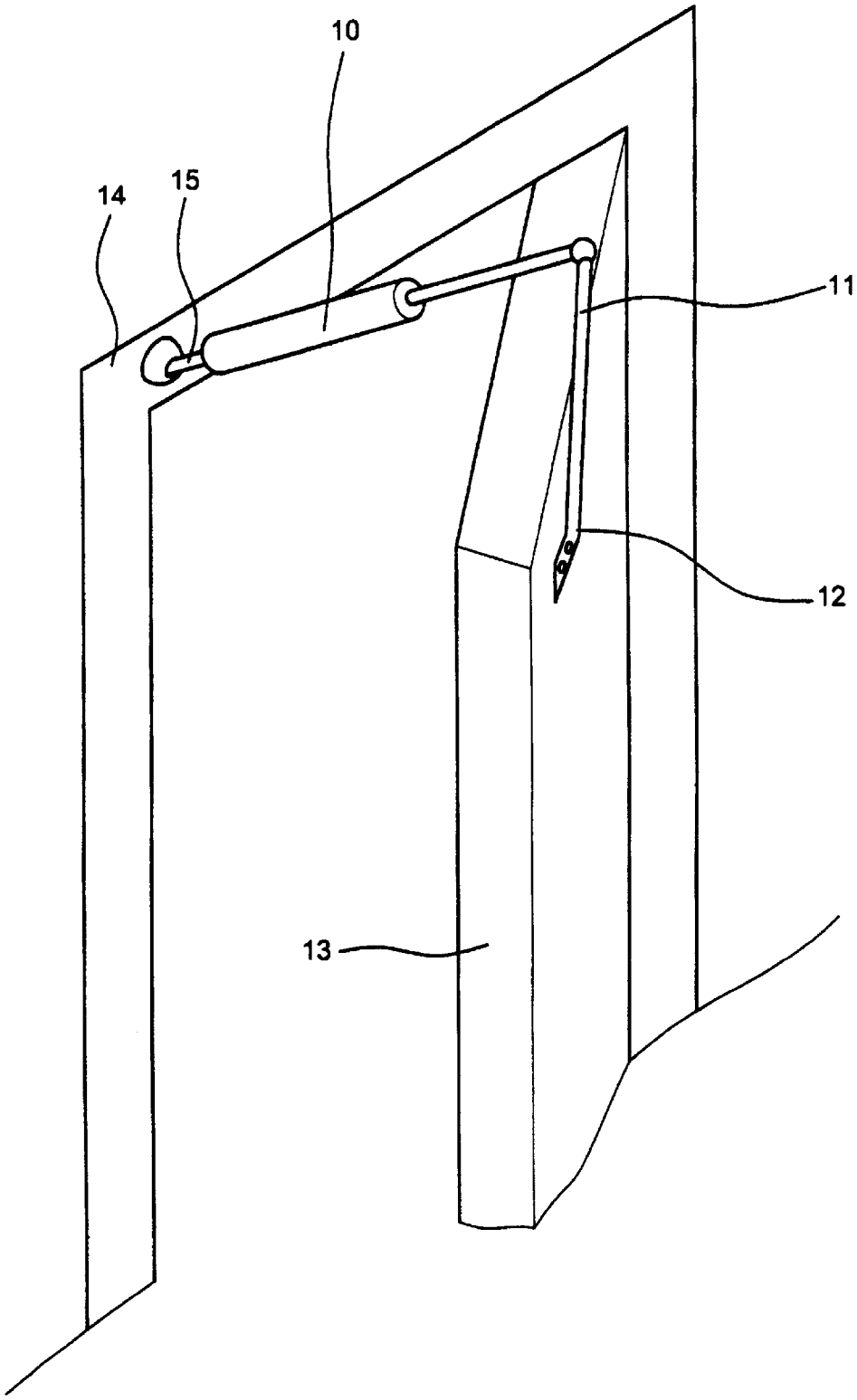
FIG.1 Prior Art
FIG. 1 is a perspective view showing an automatic door closer according a prior art.
Figure 2:
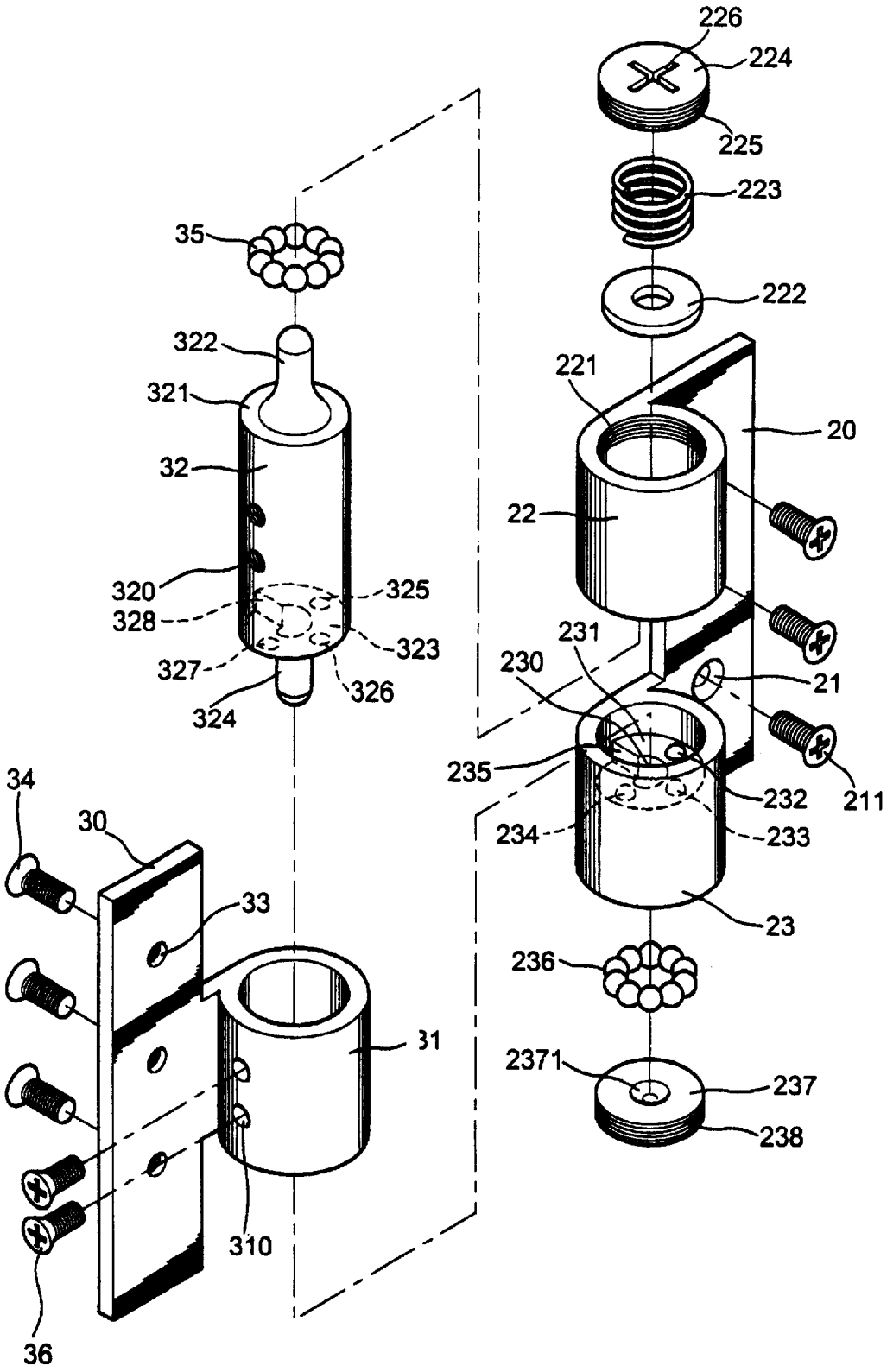
FIG. 2 is an exploded perspective view showing a preferred embodiment of a hinge according to the present invention.
Figure 3:
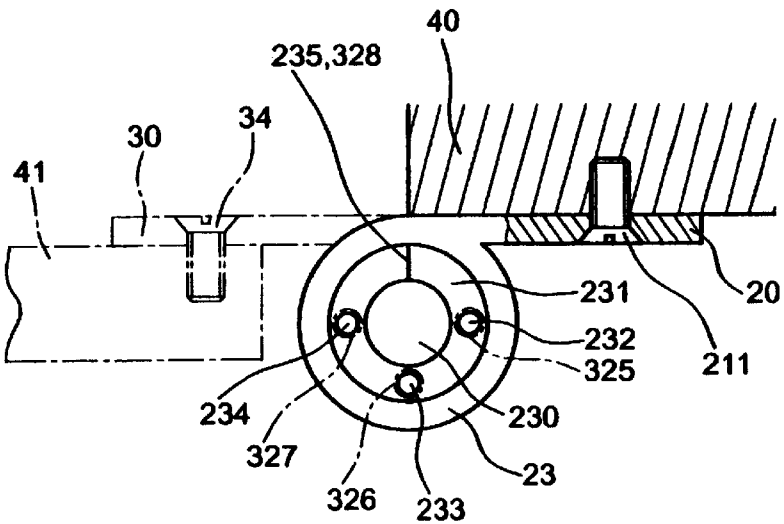
FIG. 3 is a top view of the hinge of the present invention while the door is closed.

With reference to FIGS. 2 and 3 of the drawings, the structure of a hinge of the present invention comprises generally a first leave 20 and a second leave 30 rotatably engaged with the first leave 20.

The first leave 20 includes a plurality of first screw holes 21 spacedly formed along the longitudinal length for securing the leave 20 onto a door frame 40 by screws 211, an upper knuckle 22 and a lower knuckle 23 integrated with one lateral side of the leave 20 and respectively abutting the upper and lower edges of the leave 20 so as to define a space therebetween. The upper knuckle 22 has a first threaded inner periphery abutting the upper rim for receiving a first cap 224 which has a first threaded outer periphery 225 engageable with the first inner periphery 221 of the upper knuckle 22 and a Phillips slot 226 in the top for facilitating a screwdriver of phillips head to fasten the cap 224 into the upper knuckle 22. The lower knuckle 23 has a central bore 230 defined by a central partition on the top of which is a first helical surface 231, three domes 232, 233 and 234 spacedly formed on the helical surface 231 and positioned perpendicular to each other, a first vertical surface 235 define at an end of the helical surface 231 and positioned opposite dome 233, and a second threaded inner periphery 239 (as shown in FIG. 4) abutting the lower rim of the lower knuckle 23 for receiving a second cap 237 which has a second threaded outer periphery 238 engageable with the second threaded inner periphery 239 of the knuckle 23 and a taper recess 2371 centrally formed in the top.

The second leave 30 includes a plurality of second screw holes 33 spacedly formed along the longitudinal length for securing the leave 30 onto a back side of a door 41 (the leave 30 may possibly secure to a lateral side of the door 41 if it changes its angle with the first leave 20 at manufacturing stage) and a central knuckle 31 integrated with one side of the leave 30 engageable into the space between the upper and lower knuckles 22 and 23 of the first leave 20, and a pintle 32 engageable into the central knuckle 31 and secured by screws 36 via the thru holes 310 of the knuckle 31 and a third screw holes 320 of the pintle 32 which farther has a tapered axial rod 322 projected upward from a shoulder 321 at the upper end of the pintle 32, a second helical surface 323 on the lower end engageable with the first helical surface of the lower knuckle 23, three semi-circular recesses 325, 326 and 327 spacedly from on the second helical surface 323 positioned perpendicular to each other and engageable with the domes 232, 233 and 234, a second vertical surface 328 defined at an end of the helical surface 323 engageable with the first vertical surface 235 of the first helical surface 231 and a cylinder axial rod 324 projected downward from the center of the second helical surface 323 and engageable with the central bore 230.

Figure 4:
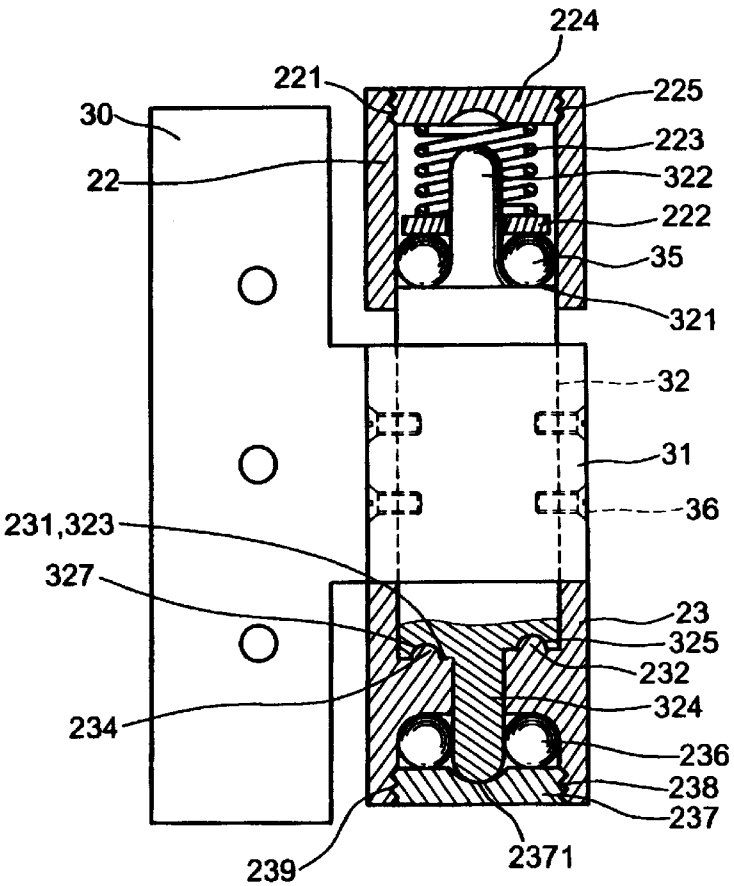
FIG. 4 is a sectional view of the hinge of the present invention.

When assembly, first engage the central knuckle 31 of the second leave 30 into the space between the upper and lower knuckles 22 and 23 of the first leave 20 and insert the pintle 32 into the central knuckle 31 through the upper knuckle 22, then secure the pintle 32 to the central knuckle 31 with screws 36 through the thru holes 310 and the third screw holes 320 as decribed the above, where the cylinder axial rod 324 is inserted into the central bore 230 of the lower knuckle 23 and the second helical surface 323 is engaged with the first helical surface 231 so as the semi-circular recesses 325, 326 and 327 that engage with the domes 232, 233 and 234, secondly and sequentially, dispose a first bead ring 35, a washer 222 and a coil spring 223 into the upper knuckle 22 which are fastened by the first cap 224 on the top of the upper knuckle 22, thirdly dispose a second bead ring 236 into the lower end of the lower knuckle 23 which is fastened by the second cap 237 where the taper recess 2371 of the second cap 237 engages with the lower end of the cylinder axial rod 324 (as shown in FIG. 4). Note that the bead rings 35 and 236 are used to prevent the friction that may occurred in the hinge and the first cap 224 is adjustable by a screwdriver to adjust the resilience of the coil spring 223.

Referring to FIGS. 3 and 4 again, when the door 30 is in closed position, the second vertical surface 328 is engaged with the first vertical surface 235 and the semi-circular recesses 325, 326 and 327 are respectively engaged with the domes 232, 233 and 234 so as to prevent the door making a noise.

Figure 6:
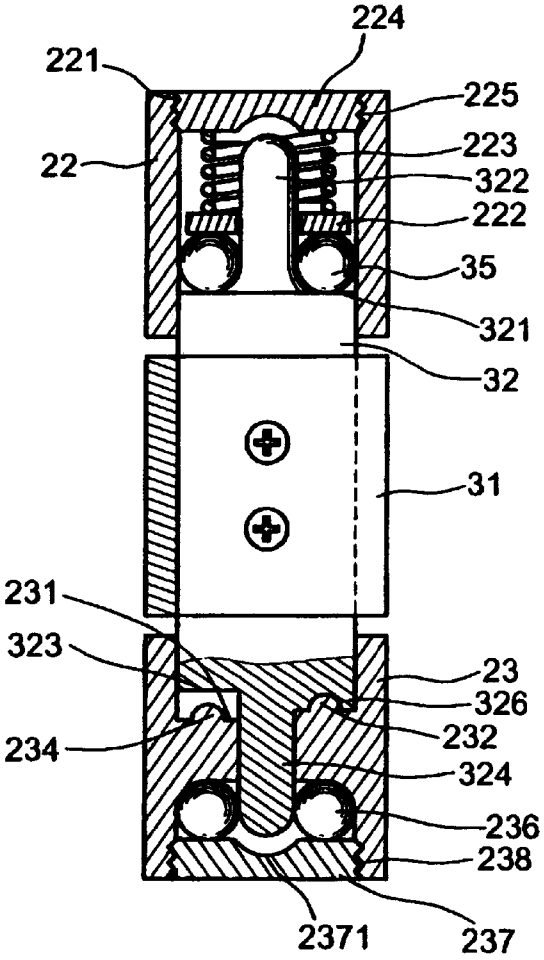
FIG. 6 is a sectional view of FIG. 5.
Figure 5:
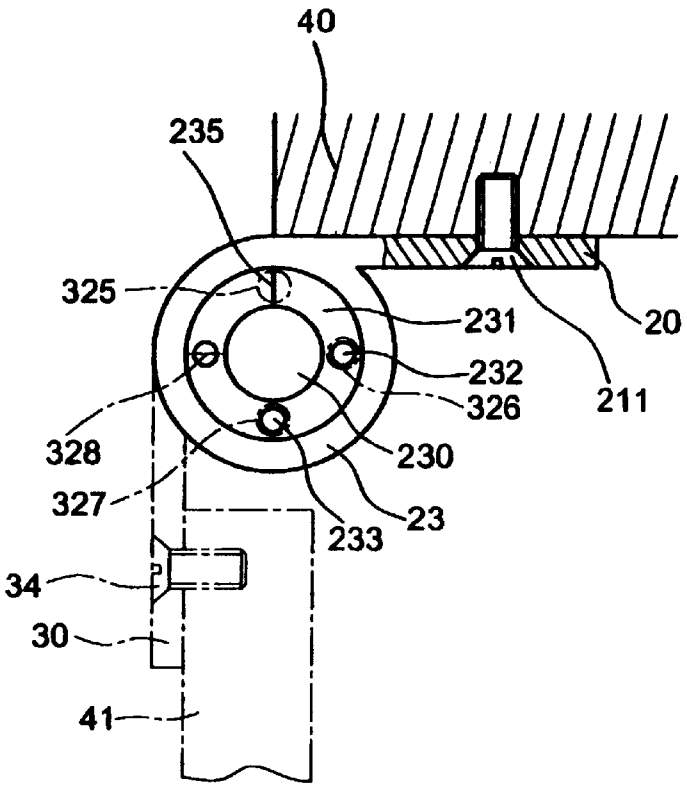
FIG. 5 is a top view of the hinge of the present invention while the door is opened for about 90°.

Referring to FIGS. 5 and 6, when the door 41 is opened for about 90° relative to the frame 40, the central knuckle 31 together with the pintle 32 are slightly lifted up and only the semi-circular recesses 326 and 327 are engaged with the domes 232 and 233. This time a slight leftward pressure applied to door 41, it will be slowly closed on its own weight and because of the helical surfaces 231 and 323 as well as the coil spring 223 and the domes 232, 233 and 234 which provide certain frictions to retard the closing movement of the door 41.

Figure 8:
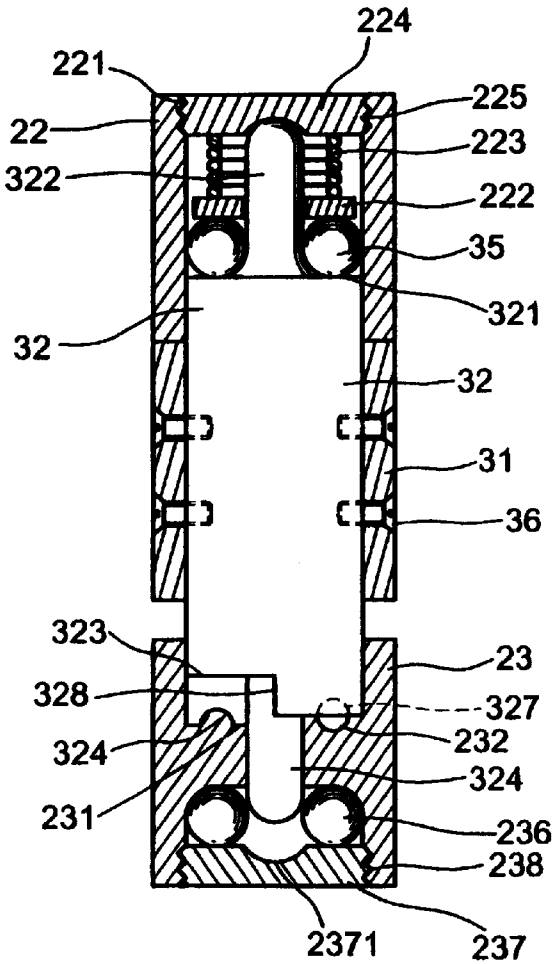
FIG. 8 is a sectional view of FIG. 7.
Figure 7:
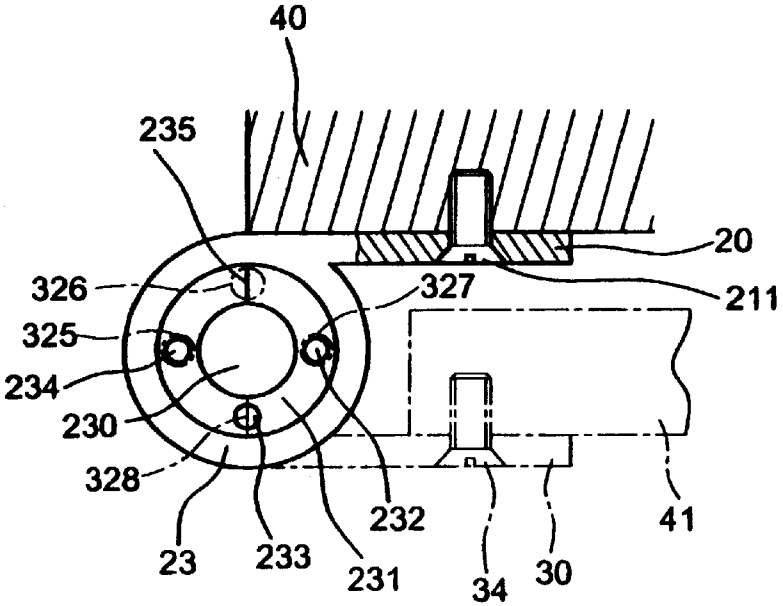
FIG. 7 is a top view of the hinge of the present invention while the door is opened for about 180°.

Referring to FIGS. 7 and 8, when the door 41 is opened for about 180° relative to the frame 40. The central knuckle 31 together with pintle 32 are lifted up to a highest position where the semi-circular recess 325, 326 and 327 are all engaged with the domes 232, 233 and 234, and the vertical surfaces 328 and 235 are position opposite to each other and the coil spring 223 is biased to a closest condition. This time, releases the door 41, it will be automatically and slowly closed as decribed the above.

If applies some lubricating oil in the bead rings 35 and 236 or between the helical surfaces 231 and 323, the hinge will be operated more smooth.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A hinge comprising:

a first leave member having a plurality of first screw holes formed spaced apart along a longitudinal length thereof for securing said first leave member by screws, an upper knuckle and a lower knuckle formed spaced apart and integrated with one lateral said of said first leave member and respectively adjacent upper and lower edges thereof so as to define a receiving space therebetween;

said upper knuckle having a first threaded inner periphery adjacent an upper rim of said upper knuckle;

said lower knuckle having a central partition which has a central bore, a first helical surface formed on a top of said central partition, a first, second and third domes formed spaced apart on said first helical surface perpendicular to each other and a first vertical surface defined at an end of said first helical surface opposite to the second dome, and a second threaded inner periphery adjacent a lower rim of said lower knuckle;

a second leave member having a plurality of second screw holes formed spaced apart along a longitudinal length thereof for securing said second leave member by screws, a central knuckle integrated with a lateral side of said second leave member and engaged into the receiving space of said first leave member and a pair of thru holes formed spaced apart in a periphery of the central knuckle;

a pintle member inserted into the central knuckle of said second leave member through the upper knuckle of said first leave member, said pintle member having a shoulder on an upper end, a tapered axial rod centrally projected upward from the shoulder, a pair of third screw holes formed spaced apart in a periphery of said pintle member and engaged with the thru holes of the central knuckle of said second leave member for securing the pintle member to the central knuckle by means of screws, a second helical surface formed on a lower end of said pintle member engageable with the first helical surface of the lower knuckle of said first leave member, a first, second and third recess formed spaced apart in the second helical surface perpendicular to each other and engageable with the first, second and third domes of the lower knuckle respectively, a second vertical surface defined at an end of the second helical surface engageable with the first vertical surface of the lower knuckle and a cylinder axial rod centrally projected downward from the second helical surface and engaged into the central bore of the lower knuckle;

a first bead ring disposed into the upper knuckle on the shoulder of said pintle member;

a washer disposed on said first bead ring;

a spring means disposed on said washer;

a first cap adjustably secured into the upper rim of said upper knuckle, said first cap having a first threaded outer periphery engaged with the first threaded inner periphery of said upper knuckle and a phillips slot on top for facilitating a screwdriver to fasten the first cap to the upper knuckle;

a second bead ring disposed into lower end of said lower knuckle on the cylinder axial rod of said pintle member;

a second cap engaged into the lower rim of said lower knuckle on an outer side of the second bead ring, said second cap having a second threaded outer periphery engaged with the second threaded inner periphery of said lower knuckle and a tapered recess centrally formed and engageable with a lower end of said cylinder axial rod;

wherein when said door opens, said semi-circular recesses will respectively engage with said domes which provide friction to retard the movement when said door is closing on its own weight.

* * * * *